US010775083B2

(12) United States Patent
Togano et al.

(10) Patent No.: US 10,775,083 B2
(45) Date of Patent: Sep. 15, 2020

(54) PURGING DEVICE, CHILLER EQUIPPED WITH SAME, AND METHOD FOR CONTROLLING PURGING DEVICE

(71) Applicant: MITSUBISHI HEAVY INDUSTRIES THERMAL SYSTEMS, LTD., Tokyo (JP)

(72) Inventors: Yoshie Togano, Tokyo (JP); Kazuki Wajima, Tokyo (JP); Naoya Miyoshi, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 155 days.

(21) Appl. No.: 16/067,351

(22) PCT Filed: Mar. 29, 2017

(86) PCT No.: PCT/JP2017/012784
§ 371 (c)(1),
(2) Date: Jun. 29, 2018

(87) PCT Pub. No.: WO2017/170627
PCT Pub. Date: Oct. 5, 2017

(65) Prior Publication Data

US 2019/0041110 A1 Feb. 7, 2019

(30) Foreign Application Priority Data

Mar. 31, 2016 (JP) ..... 2016-071996

(51) Int. Cl.
*F25B 43/04* (2006.01)
*F25B 1/10* (2006.01)
(Continued)

(52) U.S. Cl.
CPC ..... *F25B 43/04* (2013.01); *F25B 43/043* (2013.01); *F25B 1/053* (2013.01); *F25B 1/10* (2013.01);
(Continued)

(58) Field of Classification Search
CPC ..... F25B 21/02; F25B 43/04; F25B 43/043; F25B 2500/07; F25B 2500/08;
(Continued)

(56) References Cited

U.S. PATENT DOCUMENTS 5,355,685 A * 10/1994 Stie ..... F25B 43/043 62/85
5,806,322 A * 9/1998 Cakmakci ..... B01D 53/04 62/85
(Continued)

FOREIGN PATENT DOCUMENTS

CN 1053117 A 7/1991
CN 104471331 A 3/2015
(Continued)

OTHER PUBLICATIONS

Chinese Office Action and Search Report for Chinese Application No. 201780006389.2, dated Dec. 30, 2019, with an English translation.
(Continued)

*Primary Examiner* — Jonathan Bradford
(74) *Attorney, Agent, or Firm* — Birch, Stewart, Kolasch & Birch, LLP

(57) ABSTRACT

A purging device that includes a purging pipe for purging a gas mixture containing a coolant and a non-condensable gas from a chiller; a purging tank; a cooling device that has a cooling heat-transfer surface provided therein which condenses the coolant in the gas mixture and is oriented in the height direction inside the purging tank; a drainage pipe for
(Continued)

discharging the liquid coolant inside the purging tank to the chiller; an exhaust; a purging tank pressure sensor for measuring the pressure inside the purging tank; and a control device which detects that an increase in the level of the liquid coolant inside the purging tank has occurred when the measured value from the purging tank pressure sensor decreases, and thereafter, increases to a prescribed value or higher, when condensing the coolant by cooling the interior of the purging tank using the cooling device.

13 Claims, 5 Drawing Sheets

(51) Int. Cl.
*F25B 25/00* (2006.01)
*F25B 1/053* (2006.01)
*F25B 21/02* (2006.01)

(52) U.S. Cl.
CPC ..... *F25B 21/02* (2013.01); *F25B 25/005* (2013.01); *F25B 2339/047* (2013.01); *F25B 2500/07* (2013.01); *F25B 2500/08* (2013.01); *F25B 2500/19* (2013.01); *F25B 2700/195* (2013.01); *F25B 2700/197* (2013.01); *F25B 2700/21161* (2013.01); *F25B 2700/21171* (2013.01)

(58) Field of Classification Search
CPC ..... F25B 2600/00; F25B 2500/25; F25B 2500/2501; F25B 2500/2507; F25B 2500/2523; F25B 2700/195; F25B 2700/197; F25B 2700/21161; F25B 2700/21171
See application file for complete search history.

(56) References Cited

U.S. PATENT DOCUMENTS

| | | | | |
|---|---|---|---|---|
| 6,260,378 | B1 * | 7/2001 | Sagar | F25B 43/043 62/149 |
| 2010/0089461 | A1 | 4/2010 | Weber | |
| 2013/0298995 | A1 | 11/2013 | McMasters et al. | |
| 2017/0219260 | A1 | 8/2017 | Togano et al. | |

FOREIGN PATENT DOCUMENTS

| | | | |
|---|---|---|---|
| CN | 104864645 | A | 8/2015 |
| EP | 0405961 | A1 | 1/1991 |
| JP | 63-70123 | A | 3/1988 |
| JP | 4-178599 | A | 6/1992 |
| JP | 7-248245 | A | 9/1995 |
| JP | 7280396 | A | 10/1995 |
| JP | 11-218436 | A | 8/1999 |
| JP | 2001-50618 | A | 2/2001 |
| JP | 2006-38346 | A | 2/2006 |
| JP | 2008-128535 | A | 6/2008 |
| JP | 2009-139260 | A | 6/2009 |
| JP | 2016-65673 | A | 4/2016 |
| WO | WO 20131165895 | A1 | 11/2013 |

OTHER PUBLICATIONS

Xu et al., "Principles of Chemical Engineering," vol. 1, Sinopec Press, Oct. 31, 1992, pp. 175-179.

* cited by examiner

PURGING DEVICE, CHILLER EQUIPPED WITH SAME, AND METHOD FOR CONTROLLING PURGING DEVICE

TECHNICAL FIELD

The present invention relates to an air bleeding device which bleeds an uncondensable gas such as air having entered a chiller, a chiller equipped with the same, and a method of controlling an air bleeding device.

BACKGROUND ART

In a cold apparatus using a refrigerant (a so-called low pressure refrigerant) in which an operating pressure during an operation partially becomes a negative pressure in the apparatus, an uncondensable gas such as air enters the apparatus from a negative pressure portion, passes through a compressor or the like, and thereafter, stays in a condenser. If the uncondensable gas stays in the condenser, condensation performance of a refrigerant in the condenser is hindered, and performance of a cold apparatus decreases. For this reason, bleeding air from the chiller and discharging the uncondensable gas to the outside of the apparatus are performed to secure certain performance. The uncondensable gas is sucked into the air bleeding device together with the refrigerant gas by the air bleeding, and the refrigerant is cooled and condensed. Accordingly, the uncondensable gas is separated from the refrigerant and is discharged to the outside of the apparatus by an exhaust pump or the like (refer to PTLs 1 and 2).

If a liquid refrigerant condensed by the air bleeding device is collected in an air bleeding tank included in the air bleeding device and an amount of the refrigerant liquid is equal to or more than a predetermined amount, the refrigerant liquid is returned from the air bleeding device to the chiller. In the related art, in order to ascertain the amount of refrigerant liquid in the air bleeding tank, a method of detecting a liquid level in the air bleeding tank is adopted, the liquid level is detected by a float type liquid level sensor, and a method of opening an automatic on/off valve such as a solenoid valve to return the liquid refrigerant liquid to the inside of the chiller if the liquid level reaches a predetermined liquid level or a method of installing a self-supporting float valve for opening a valve if the liquid level in the air bleeding tank reaches a predetermined value to return the liquid refrigerant to the inside of the chiller is adopted.

CITATION LIST

Patent Literature

[PTL 1] Japanese Unexamined Patent Application Publication No. 2001-50618

[PTL 2] Japanese Unexamined Patent Application Publication No. 2006-38346

SUMMARY OF INVENTION

Technical Problem

However, the method of detecting the liquid level using the float has a mechanical operation structure in which the float is repeatedly lifted and lowered, and thus, abrasion or the like occurs in a sliding portion, and maintenance at regular intervals is required. In addition, a float portion is required to be in contact with the surface of the refrigerant liquid, and during maintenance, it is necessary to open the inside of a refrigerant system and perform a work while checking the inside.

In this way, in the liquid level detection using the float, there are problems for which not only regular maintenance is required but also a complicated work is involved.

The present invention is made in consideration of the above-described circumstances, and an object thereof is to provide an air bleeding device having excellent maintainability capable of detecting a liquid level of a liquid refrigerant without using a float type liquid level sensor, a chiller equipped with the same, and a method of controlling an air bleeding device.

Solution to Problem

In order to achieve the above-described object, an air bleeding device, a chiller equipped with the same, and a method of controlling an air bleeding device of the present invention adopt the following means.

That is, according to an aspect of the present invention, there is provided an air bleeding device, including: an air bleeding pipe through which a mixed gas containing a refrigerant and an uncondensable gas is bled from a chiller; an air bleeding tank in which the mixed gas bled through the air bleeding pipe is stored; a cooler in which a cooling heat transfer surface which cools an inside of the air bleeding tank and condenses the refrigerant in the mixed gas is installed in a height direction in the air bleeding tank; a drain pipe through which a liquid refrigerant in the air bleeding tank is discharged to the chiller; an exhaust pipe through which the uncondensable gas in the mixed gas in the air bleeding tank is discharged to an outside; an air bleeding tank pressure sensor which measures a pressure in the air bleeding tank; and a control unit which, when the cooler cools the inside of the air bleeding tank to condense the refrigerant, detects an increase of a liquid level of the liquid refrigerant in the air bleeding tank by a measurement value of the air bleeding tank pressure sensor decreasing and thereafter, increasing so as to be a predetermined value or more.

If the inside of the air bleeding tank is cooled by the cooler, the pressure in the air bleeding tank decreases. Accordingly, a differential pressure is formed between the air bleeding tank and a refrigerant system (for example, condenser) of the chiller, and the mixed gas containing the refrigerant and the uncondensable gas is sucked from the chiller to the air bleeding tank via the air bleeding pipe. In the air bleeding tank, the refrigerant in the mixed gas is condensed by the cooler so as to be a liquid refrigerant, and the liquid refrigerant is accumulated in a lower portion of the air bleeding tank. Meanwhile, even when the uncondensable gas in the mixed gas introduced into the air bleeding tank is cooled by the cooler, the uncondensable gas is not condensed, and thus, the uncondensable gas stays in the air bleeding tank in a gas state. Accordingly, the refrigerant and the uncondensable gas are separated from each other in the air bleeding tank. The separated uncondensable gas is discharged to the outside via the exhaust pipe. The liquid refrigerant accumulated in the air bleeding tank is discharged to the chiller (for example, the evaporator) via the drain pipe and is reused as the refrigerant.

The cooling heat transfer surface of the cooler is installed in the height direction in the air bleeding tank, and thus, the liquid level of the liquid refrigerant accumulated in the lower portion of the air bleeding tank increases, the cooling heat transfer surface is immersed in the liquid refrigerant. If the cooling heat transfer surface is immersed in the liquid refrigerant, a heat transfer area for cooling the mixed gas decreases, and thus, condensation capacity decreases, and the pressure in the air bleeding tank increases. In this way, if the inside of the air bleeding tank is cooled, the pressure in the air bleeding tank decreases. However, if the condensation of the refrigerant in the air bleeding tank proceeds, the liquid refrigerant is accumulated in the air bleeding tank, the liquid refrigerant covers the cooling heat transfer surface, and thus, the pressure in the air bleeding tank increases due to the decrease of the cooling heat transfer surface. Accordingly, by measuring the pressure in the air bleeding tank by the air bleeding tank pressure sensor and by ascertaining the measurement value decreasing and thereafter, increasing so as to be the predetermined value or more, the increase of the liquid level of the liquid refrigerant in the air bleeding tank is detected.

In this way, it is possible to detect the liquid level of the liquid refrigerant in the air bleeding tank by the air bleeding tank pressure sensor without using a float type liquid level sensor, and thus, it is possible to provide the air bleeding device having excellent maintainability.

In addition, according to another aspect of the present invention, there is provided an air bleeding device, including: an air bleeding pipe through which a mixed gas containing a refrigerant and an uncondensable gas is bled from a chiller; an air bleeding tank in which the mixed gas bled through the air bleeding pipe is stored; a cooler which cools an inside of the air bleeding tank and condenses the refrigerant in the mixed gas; a drain pipe through which a liquid refrigerant in the air bleeding tank is discharged to the chiller; an exhaust pipe through which the uncondensable gas in the mixed gas in the air bleeding tank is discharged to an outside; and a control unit which detects an increase of a liquid level of the liquid refrigerant in the air bleeding tank by a condensed refrigerant amount in the air bleeding tank calculated from cooling capacity of the cooler and condensed latent heat of the refrigerant being a predetermined value or more.

If the inside of the air bleeding tank is cooled by the cooler, the pressure in the air bleeding tank decreases. Accordingly, the differential pressure is formed between the air bleeding tank and the refrigerant system (for example, condenser) of the chiller, and the mixed gas containing the refrigerant and the uncondensable gas is sucked from the chiller to the air bleeding tank via the air bleeding pipe. In the air bleeding tank, the refrigerant in the mixed gas is condensed by the cooler so as to be the liquid refrigerant, and the liquid refrigerant is accumulated in the lower portion of the air bleeding tank. Meanwhile, even when the uncondensable gas in the mixed gas introduced into the air bleeding tank is cooled by the cooler, the uncondensable gas is not condensed, and thus, the uncondensable gas stays in the air bleeding tank in a gas state. Accordingly, the refrigerant and the uncondensable gas are separated from each other in the air bleeding tank. The separated uncondensable gas is discharged to the outside via the exhaust pipe. The liquid refrigerant accumulated in the air bleeding tank is discharged to the chiller (for example, the evaporator) via the drain pipe and is reused as the refrigerant.

A condensation amount of the chiller introduced into the air bleeding tank can be calculated from the cooling capacity of the cooler and the condensed latent heat of the refrigerant. Accordingly, the increase of the liquid level of the liquid refrigerant in the air bleeding tank is detected from the calculated condensation amount.

In this way, it is possible to detect the liquid level of the liquid refrigerant in the air bleeding tank by the calculation without using a float type liquid level sensor, and thus, it is possible to provide the air bleeding device having excellent maintainability.

In addition, in the air bleeding device according to the other aspect of the present invention, in a case where the control unit detects the increase of the liquid level of the liquid refrigerant in the air bleeding tank, the liquid refrigerant is discharged from the air bleeding tank via the drain pipe.

As described above, if the increase of the liquid level of the liquid refrigerant in the air bleeding tank is detected, the liquid refrigerant is discharged from the drain pipe to the refrigerant system. Accordingly, it is possible to return the refrigerant discharged from the chiller.

In addition, in the air bleeding device according to the other aspect of the present invention, in a case where the liquid refrigerant is discharged from the air bleeding tank, and thereafter, a pressure in the air bleeding tank does not decrease to a predetermined value or less, the control unit determines that the uncondensable gas of a predetermined amount or more stays in the air bleeding tank.

If the liquid refrigerant is discharged from the air bleeding tank, the immersion of the cooling heat transfer surface of the cooler is eliminated and the cooling capacity is recovered, and thus, the pressure in the air bleeding tank decreases. However, if the uncondensable gas of the predetermined amount or more stays in the air bleeding tank, the uncondensable gas covers the cooling heat transfer surface, and thus, heat transfer performance decreases. Accordingly, in the case where the liquid refrigerant is drained, and thereafter, the pressure in the air bleeding tank does not decrease to a predetermined value or less, it can be determined that the uncondensable gas of the predetermined amount or more stays in the air bleeding tank.

In addition, in the air bleeding device according to the other aspect of the present invention, in a case where the control unit determines that the uncondensable gas of the predetermined amount or more stays in the air bleeding tank, a gas in the air bleeding tank is discharged from the exhaust pipe to the outside.

In the case where it is determined that the uncondensable gas of the predetermined amount or more stays in the air bleeding tank, the uncondensable gas is removed from the air bleeding tank by discharging the gas in the air bleeding tank from the exhaust pipe to the outside. Accordingly, the heat transfer performance of the cooler is recovered, the uncondensable gas entering the refrigerant system of the chiller is separated from the refrigerant and thus, can be discharged to the outside.

In addition, according to still another aspect of the present invention, there is provided a chiller including: any one of the above-described air bleeding devices.

Any one of the above-described air bleeding devices is provided, and thus, it is possible to provide the chiller having excellent maintainability.

Moreover, according to still another aspect of the present invention, there is provided a method of controlling an air bleeding device, the air bleeding device including an air bleeding pipe through which a mixed gas containing a refrigerant and an uncondensable gas is bled from a chiller, an air bleeding tank in which the mixed gas bled through the air bleeding pipe is stored, a cooler in which a cooling heat transfer surface which cools an inside of the air bleeding tank and condenses the refrigerant in the mixed gas is installed in a height direction in the air bleeding tank, a drain pipe through which a liquid refrigerant in the air bleeding tank is discharged to the chiller, an exhaust pipe through which the uncondensable gas in the mixed gas in the air bleeding tank is discharged to an outside, and an air bleeding tank pressure sensor which measures a pressure in the air bleeding tank, the method including: detecting, when the cooler cools the inside of the air bleeding tank to condense the refrigerant, an increase of a liquid level of the liquid refrigerant in the air bleeding tank by a measurement value of the air bleeding tank pressure sensor decreasing and thereafter, increasing so as to be a predetermined value or more.

Moreover, according to still another aspect of the present invention, there is provided a method of controlling an air bleeding device, the air bleeding device including an air bleeding pipe through which a mixed gas containing a refrigerant and an uncondensable gas is bled from a chiller, an air bleeding tank in which the mixed gas bled through the air bleeding pipe is stored, a cooler which cools an inside of the air bleeding tank and condenses the refrigerant in the mixed gas, a drain pipe through which a liquid refrigerant in the air bleeding tank is discharged to the chiller, and an exhaust pipe through which the uncondensable gas in the mixed gas in the air bleeding tank is discharged to an outside, the method including: detecting an increase of a liquid level of the liquid refrigerant in the air bleeding tank by a condensed refrigerant amount in the air bleeding tank calculated from cooling capacity of the cooler and condensed latent heat of the refrigerant being a predetermined value or more.

Advantageous Effects of Invention

By detecting the liquid level of the liquid refrigerant by the change of the pressures in the air bleeding tank or detecting the liquid level of the liquid refrigerant by the cooling capacity of the cooler cooling the air bleeding tank and the condensed latent heat of the refrigerant, it is possible to detect the liquid level of the liquid refrigerant without using a float type liquid level sensor, and thus, it is possible to provide the air bleeding device having excellent maintainability.

DESCRIPTION OF EMBODIMENTS

Hereinafter, an embodiment of the present invention will be described with reference to the drawings.

Figure 1:
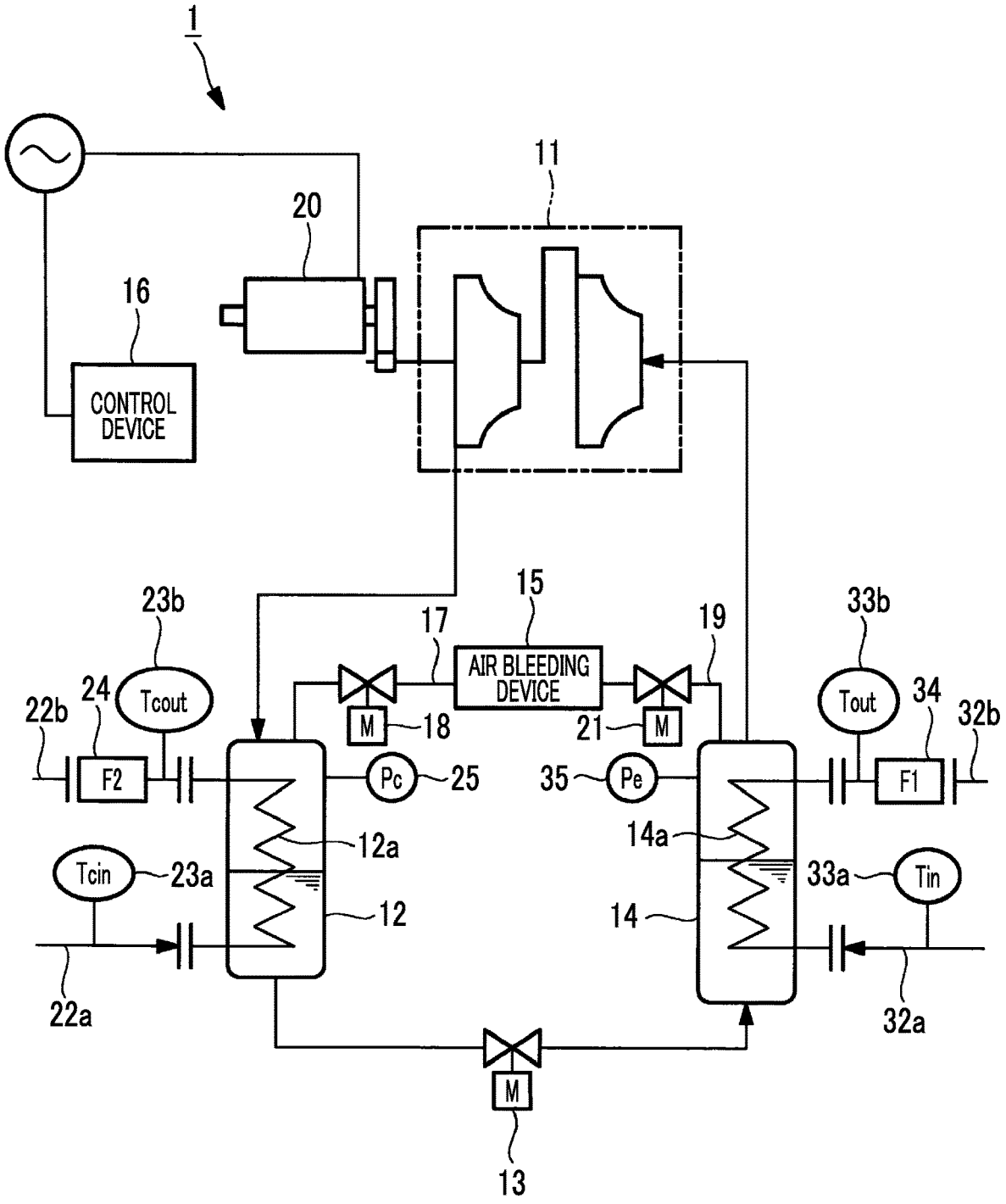
FIG. 1 is a schematic configuration diagram showing a chiller using an air bleeding device according to an embodiment of the present invention.

FIG. 1 shows a schematic configuration diagram showing a chiller using an air bleeding device of the present invention. As shown in FIG. 1, the chiller 1 is a centrifugal chiller, and mainly includes a turbo type compressor 11 which compresses a refrigerant, a condenser which condenses a high-temperature and high-pressure gas refrigerant which is compressed by the compressor 11, an expansion valve 13 which expands a liquid refrigerant from the condenser 12, an evaporator 14 which evaporates the liquid refrigerant expanded by the expansion valve 13, an air bleeding device 15 which discharges air (uncondensable gas) entering a refrigerant system of the chiller 1 to the atmosphere, and a control device (control unit) 16 which controls portions included in the chiller 1.

For example, as the refrigerant, a low-pressure refrigerant such as HFO-1233Zd(E) is used, and during an operation, a pressure of a low-pressure portion such as the evaporator becomes the atmospheric pressure or less.

The compressor 11 is a multi-stage centrifugal compressor which is driven by an inverter motor 20. An output of the inverter motor 20 is controlled by the control device 16.

For example, the condenser 12 is a shell and tube type heat exchanger. A cooling water heat transfer tube 12*a* through which a cooling water for cooling the refrigerant flows is inserted into the condenser 12. A cooling water forward pipe 22*a* and a cooling water return pipe 22*b* are connected to the cooling water heat transfer tube 12*a*. The cooling water introduced to the condenser 12 via the cooling water forward pipe 22*a* is introduced to a cooling tower (not shown) via the cooling water return pipe 22*b*, heat of the cooling water is exhausted to the outside, and thereafter, the cooling water is introduced to the condenser 12 again via the cooling water forward pipe 22*a*.

In the cooling water forward pipe 22*a*, a cooling water pump (not shown) which feeds the cooling water and a cooling water inlet temperature sensor 23*a* which measures a cooling water inlet temperature Tcin are provided. In the cooling water return pipe 22*b*, a cooling water outlet temperature sensor 23*b* which measures a cooling water outlet temperature Tcout and a cooling water flow rate sensor 24 which measures a cooling water flow rate F2 are provided.

A condenser pressure sensor 25 which measures a condensation pressure Pc in the condenser 12 is provided in the condenser 12.

Measurement values of the sensors 23*a*, 23*b*, 24, and 25 are sent to the control device 16.

The expansion valve 13 is an electric expansion valve 13 and an opening degree of the expansion valve 13 is set by the control device 16.

For example, the evaporator 14 is a shell and tube type heat exchanger. A chilled water heat transfer tube 14*a* through which a chilled water which performs heat exchange with the refrigerant flows is inserted into the evaporator 14. A chilled water forward pipe 32*a* and a chilled water return pipe 32*b* are connected to the chilled water heat transfer tube 14*a*. The chilled water introduced to the evaporator 14 via the chilled water forward pipe 32*a* is cooled to a rated temperature (for example, 7° C.) and is introduced to an external load (not shown) via the chilled water return pipe 32*b* so as to supply a cold heat, and thereafter, the chilled water is introduced to the evaporator 14 again via the chilled water forward pipe 32*a*.

In the cooling water forward pipe 32*a*, a chilled water pump (not shown) which feeds the chilled water and a chilled water inlet temperature sensor 33*a* which measures a chilled water inlet temperature Tin are provided. In the chilled water return pipe 32*b*, a chilled water outlet temperature sensor 33*b* which measures a chilled water outlet temperature Tout and a chilled water flow rate sensor 34 which measures a chilled water flow rate F1 are provided.

An evaporation pressure sensor 35 which measures an evaporation pressure Pe in the evaporator 14 is provided in the evaporator 14.

Measurement values of the sensors 33*a*, 33*b*, 34, and 35 are sent to the control device 16.

The air bleeding device 15 is provided between the condenser 12 and the evaporator 14. An air bleeding pipe 17 for introducing a mixed gas containing the refrigerant and the uncondensable gas (air) from the condenser 12 is connected to the air bleeding device 15. An air bleeding solenoid valve (air bleeding valve) 18 for controlling a flow and shut-off of the mixed gas is provided in the air bleeding pipe 17. Opening and closing of the air bleeding solenoid valve 18 are controlled by the control device 16.

A drain pipe 19 through which the liquid refrigerant condensed in the air bleeding device 15 is discharged to the evaporator 14 is connected to the air bleeding device 15. A drain solenoid valve (drain valve) 21 for controlling the flow and the shut-off of the liquid refrigerant is provided in the drain pipe 19. The opening and closing of the drain solenoid valve 21 is controlled by the control device 16.

Figure 2:
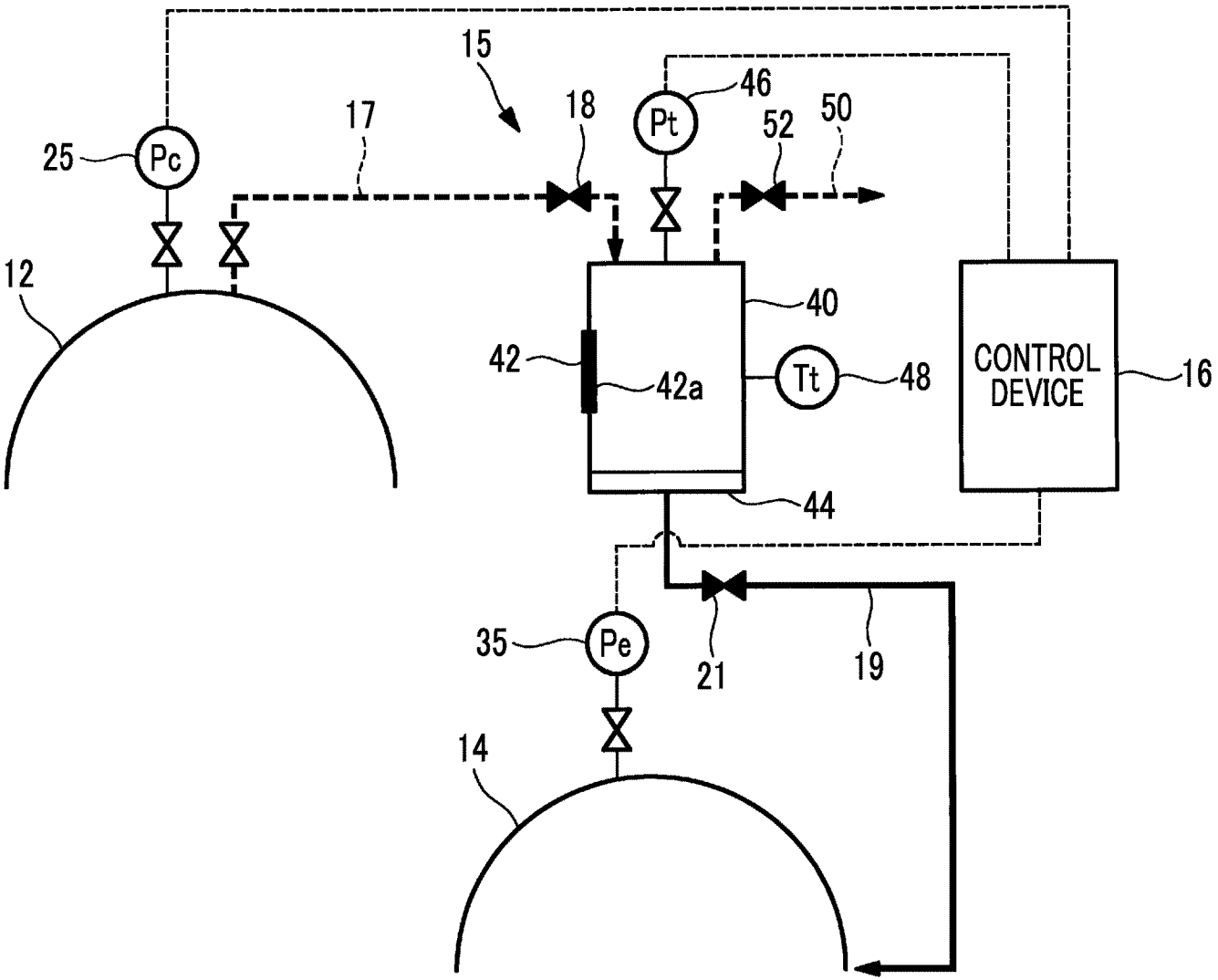
FIG. 2 is a schematic configuration diagram showing the vicinity of the air bleeding device of FIG. 1.

FIG. 2 shows a configuration around the air bleeding device 15. The air bleeding device 15 includes an air bleeding tank 40 in which the mixed gas containing the refrigerant and the uncondensable gas introduced from the air bleeding pipe 17 is stored. A cooler 42 for cooling an inside of the air bleeding tank 40 and a heater 44 for heating the inside of the air bleeding tank 40 are provided in the air bleeding tank 40.

The cooler 42 includes a Peltier element and is provided such that a cooling heat transfer surface 42*a* cooled by the Peltier element is exposed to the inside of the air bleeding tank 40. The cooling heat transfer surface 42*a* is provided in a vertical direction of the air bleeding tank 40. A power supply portion (not shown) is connected to the Peltier element of the cooler 42. A current flowing to the power supply portion is controlled by the control device 16, and thus, starting and stopping of the cooler 42 are switched. In addition, a heat dissipating portion (not shown) for releasing heat absorbed by the cooling heat transfer surface 42*a* to the outside is provided in the Peltier element of the cooler 42. A water cooling device which allows a cooling water to flow through is provided in the heat dissipating portion, and is configured to dissipate the heat at a constant temperature. In addition, the heat dissipating portion may be an air-cooling type heat dissipating portion which does not include the water cooling device.

For example, the heater 44 is an electric heater, and is attached to a bottom portion of the air bleeding tank 40. Starting and stopping of the heater 44 are controlled by the control device 16.

In the air bleeding tank 40, an air bleeding tank pressure sensor 46 for detecting a pressure Pt in the air bleeding tank 40 and an air bleeding tank temperature sensor 48 for detecting a temperature Tt in the air bleeding tank 40 are provided. Measurement values of the sensors 46 and 48 are sent to the control device 16.

An exhaust pipe 50 through which gas (mainly, uncondensable gas) in the air bleeding tank 40 is exhausted is connected to an upper portion of the air bleeding tank 40. An exhaust solenoid valve (exhaust valve) 52 for controlling a flow and shut-off of the gas is provided in the exhaust pipe 50. Opening and closing of the exhaust solenoid valve 52 are controlled by the control device 16.

The control device 16 has a function of controlling the rotational speed of the compressor 11 or the like or a control function of the air bleeding device 15, based on measurement values received from each sensor, a load ratio sent from a host system, or the like.

For example, the control device 16 includes a Central Processing Unit (CPU), a memory such as a Random Access Memory (RAM), a computer readable storage medium, or the like, which is not shown. A series of processing for realizing various functions described below is stored in the storage medium or the like as a program form, and the CPU reads the program to a RAM or the like and executes information processing/calculation processing to realize the various functions described below.

The above-described chiller 1 uses a low-pressure refrigerant, and thus, during the operation of the chiller 1, air which is the uncondensable gas enters the chiller 1 from a negative pressure portion. The negative pressure portion mainly is a region which has a relatively low pressure at a refrigerating cycle, such as the evaporator. However, in the winter, the pressure of the condenser 12 may be a negative pressure. The air entering the chiller is mainly accumulated in the condenser 12. The air bleeding device 15 operates the air accumulated in the condenser 12 at a predetermined interval to discharge the air in the chiller 1 to the outside.

Figure 3:
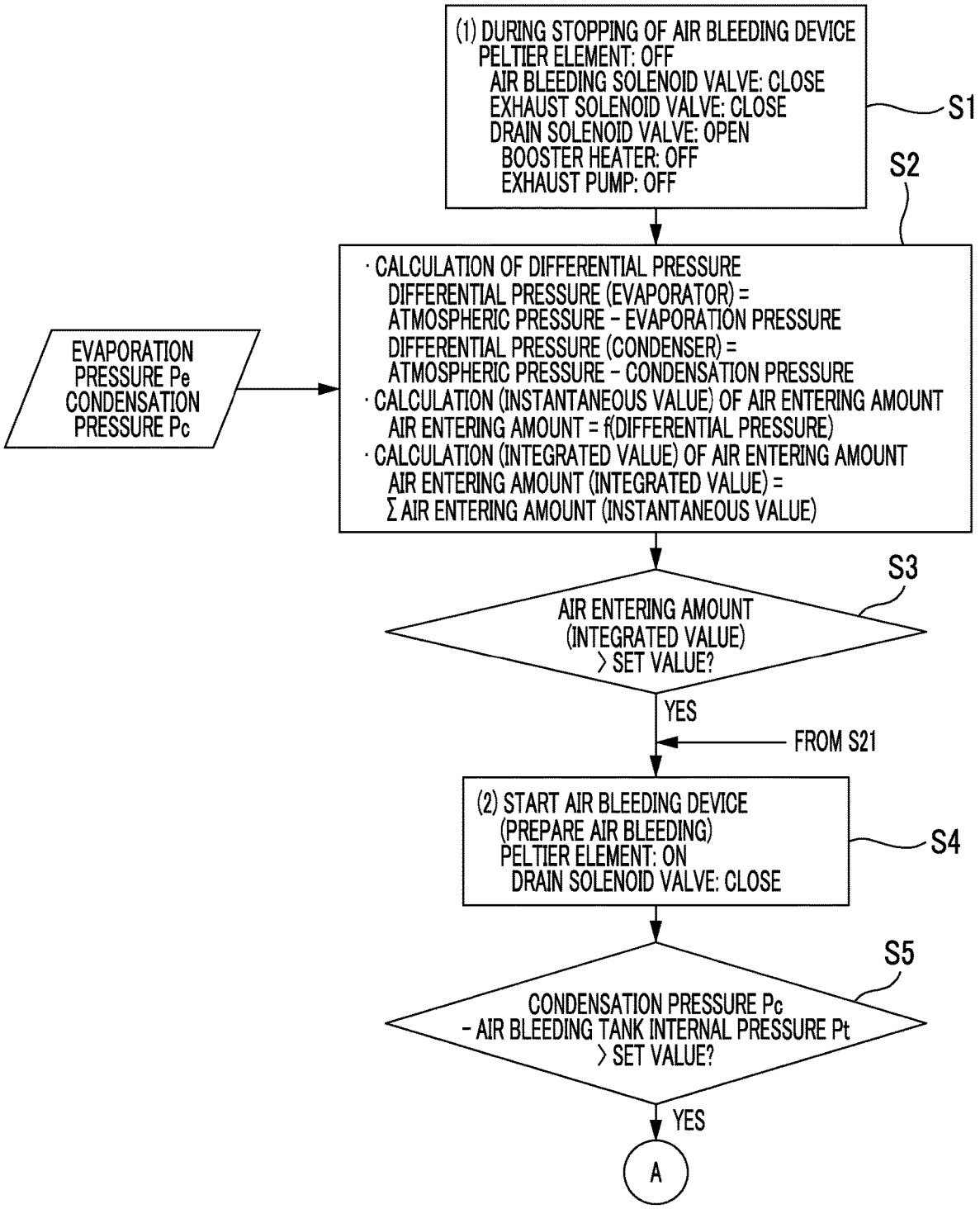
FIG. 3 is a flowchart showing an operation of the air bleeding device.
Figure 4:
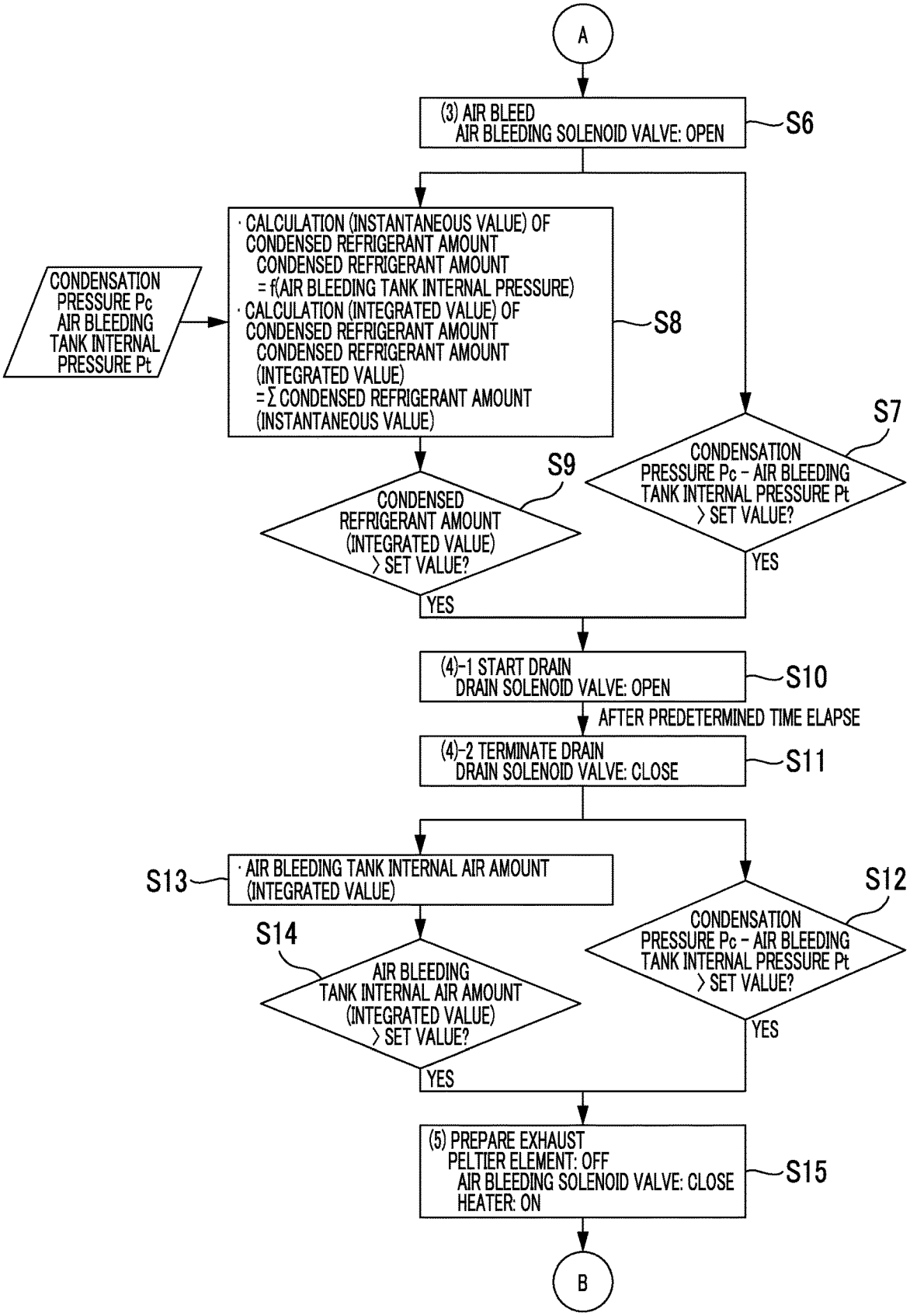
FIG. 4 is a flowchart showing the operation of the air bleeding device.
Figure 5:
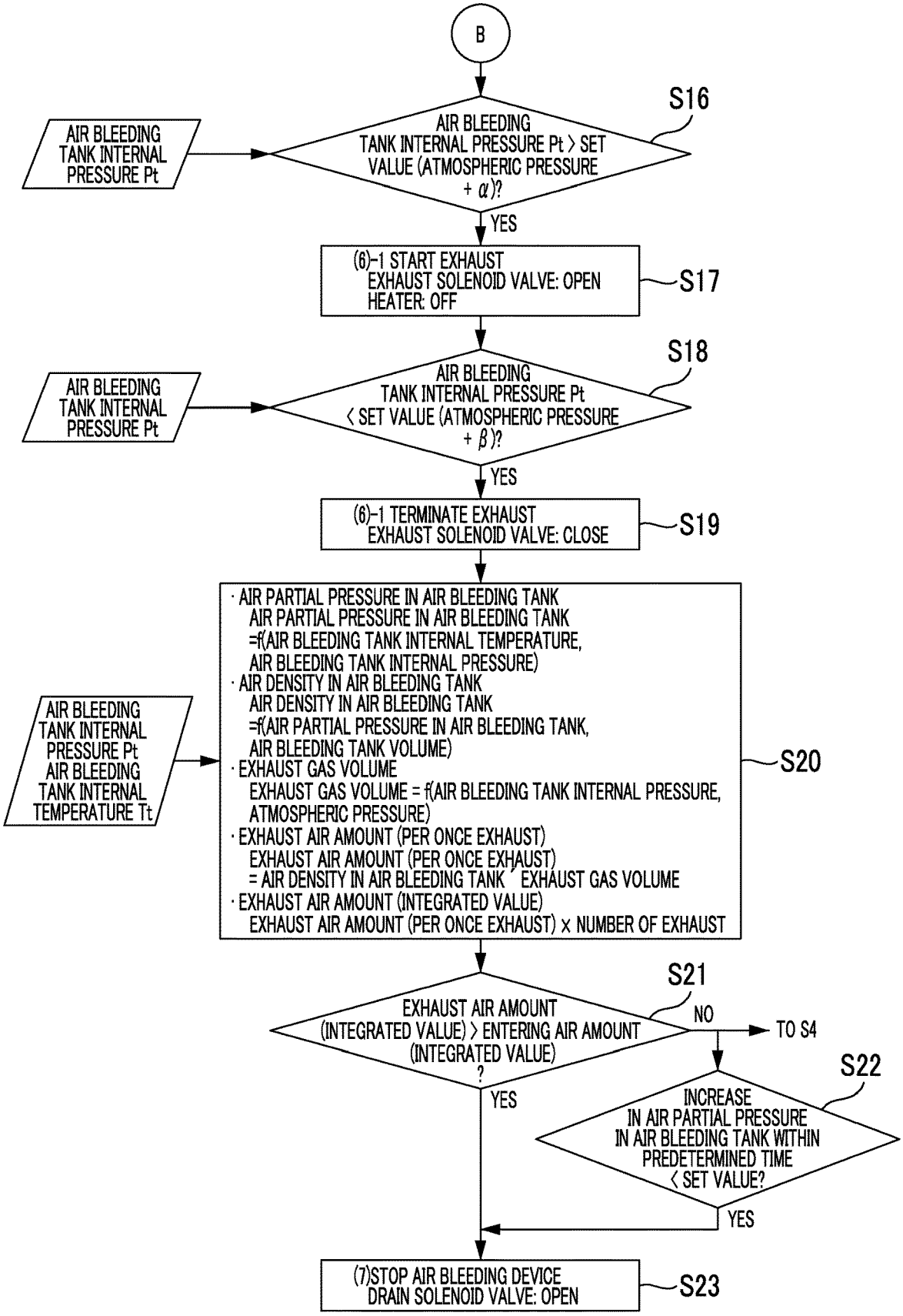
FIG. 5 is a flowchart showing the operation of the air bleeding device.

Next, the operation of the air bleeding device 15 will be described with reference to FIGS. 3 to 5.

In Table 1, operating states of the Peltier element, each solenoid valve, or the like in each step described below are collected. In the following table, ○ indicates ON or opening, and ● indicates OFF or closing.

TABLE 1

| | Operation | Peltier element | Air bleeding solenoid valve | Exhaust solenoid valve | Drain solenoid valve | Heater |
|---|---|---|---|---|---|---|
| (1) | During stopping of air bleeding device(S1) | ● | ● | ● | ○ | ● |
| (2) | Starting of air bleeding device (S4) (air bleeding preparation) | ○ | ● | ● | ● | ● |
| (3) | Air bleeding (S6) | ○ | ○ | ● | ● | ● |
| (4)-1 | Drain start(S10) | ○ | ○ | ● | ○ | ● |
| (4)-2 | Drain terminate (S11) | ○ | ○ | ● | ● | ● |
| (5) | Heater Exhaust preparation | ● | ● | ● | ● | ○ |

TABLE 1-continued

| | Operation | Peltier element | Air bleeding solenoid valve | Exhaust solenoid valve | Drain solenoid valve | Heater |
|---|---|---|---|---|---|---|
| | (S15) | | | | | |
| (6)-1 | Exhaust start (S17) | ● | ● | ○ | ● | ● |
| (6)-2 | Exhaust terminate (S19) | ● | ● | ● | ● | ● |
| (7) | Air bleeding device stop (S23) | ● | ● | ● | ○ | ● |

During the operation of the chiller 1, in a case where the amount of the air which is the uncondensable gas entering the chiller 1 is less than a predetermined value, the air bleeding device 15 is stopped (Step S1). In this case, the Peltier element of the cooler 42 is turned OFF, the air bleeding solenoid valve 18 and the exhaust solenoid valve 52 are closed, the drain solenoid valve 21 is opened, and the heater 44 is turned OFF.

In Step S2, the amount of the air entering the refrigerant system of the chiller 1 is calculated as follows. The control device 16 acquires a condensation pressure Pc from the condenser pressure sensor 25 and an evaporation pressure Pe from the evaporator pressure sensor 35 and calculates differential pressures between the condenser 12 and the evaporator 14, and the atmospheric pressure as the following Expression.

$$\text{Differential Pressure (Condenser)}=\text{Atmospheric Pressure}-\text{Condensation Pressure } Pc \quad (1)$$

$$\text{Differential Pressure (Evaporator)}=\text{Atmospheric Pressure}-\text{Evaporation Pressure } Pe \quad (2)$$

In addition, based on Expressions (1) and (2), the air entering amount (instantaneous value) is calculated as the following Expression.

$$\text{Air Entering Amount (Instantaneous Value)}=f(\text{Differential Pressure}) \quad (3)$$

That is, the air entering amount (instantaneous value) is a function (for example, a function of (differential pressure)$^{1/2}$) of the differential pressure and is the sum of the air entering amount in the condenser 12 and the air entering amount in the evaporator 14.

In addition, the amount (integrated value) of the air entering the refrigerant system of the chiller 1 is calculated as a value obtained by integrating the air entering amount (instantaneous value) with time.

$$\text{Air Entering Amount (Integrated Value)}=\Sigma\text{Air Entering Amount (Instantaneous Value)} \quad (4)$$

If the calculated air entering amount (integrated value) exceeds a predetermined set value (Step S3), a starting preparation of the air bleeding device 15 is performed (Step S4). Specifically, the Peltier element of the cooler 42 is turned ON and the drain solenoid valve 21 is closed. Accordingly, the inside of the air bleeding tank 40 becomes a closed space and absorbs the heat from the cooling heat transfer surface 42*a* by the cooling performed by the Peltier element. The temperature in the air bleeding tank 40 is decreased and the pressure in the air bleeding tank 40 is decreased by the heat absorption of the cooling heat transfer surface 42*a*.

In a case where a value obtained by subtracting the air bleeding tank pressure Pt obtained by the air bleeding tank pressure sensor 46 from the condensation pressure Pc obtained by the condenser pressure sensor 25 exceeds the set value (Step S5), the air bleeding solenoid valve 18 is opened (Step S6).

The air bleeding solenoid valve 18 is opened, and thus, the mixed gas containing the refrigerant and the air flows into the air bleeding tank 40 via the air bleeding pipe 17 from the condenser 12, according to the differential pressure between the condenser 12 and the air bleeding tank 40. In the air bleeding tank 40, the refrigerant is cooled to a condensation temperature or less and is liquefied by the cooling of the cooling heat transfer surface 42*a*. Meanwhile, the air which is the uncondensable gas is not condensed by the cooling of the cooling heat transfer surface 42*a*, and the uncondensable gas stays in the air bleeding tank 40 in a gas state.

As described below, a liquid level of the liquid refrigerant which is condensed in the air bleeding tank 40 and is accumulated in the lower portion of the air bleeding tank 40 is detected by two methods.

[Liquid Level Detection by Pressure Change (Step S7)]

As shown in Step S7, in a case where the value obtained by subtracting the air bleeding tank pressure Pt obtained by the air bleeding tank pressure sensor 46 from the condensation pressure Pc obtained by the condenser pressure sensor 25 exceeds the set value, it is determined that the liquid level of the liquid refrigerant in the air bleeding tank 40 increases. This set value is determined by experiment or the like in advance.

The cooling heat transfer surface 42*a* is installed in a height direction in the air bleeding tank 40 (refer to FIG. 2), and thus, if the liquid level of the liquid refrigerant accumulated in the lower portion of the air bleeding tank 40 increases, the cooling heat transfer surface 42*a* is immersed from the lower portion of the cooling heat transfer surface 42*a* by the liquid refrigerant. If the cooling heat transfer surface 42*a* is immersed in the liquid refrigerant, a heat transfer area cooling the gas decreases, and thus, condensation capacity decreases. If the condensation capacity decreases, the pressure Pt in the air bleeding tank 40 increases, and thus, the differential pressure between the pressure Pt and the condensation pressure Pc of the condenser 12 decreases. In this way, if the inside of the air bleeding tank 40 is cooled, the pressure in the air bleeding tank decreases. However, if the condensation of the refrigerant in the air bleeding tank 40 proceeds, the liquid refrigerant is accumulated in the air bleeding tank 40, the liquid refrigerant covers the cooling heat transfer surface 42*a*, and thus, the pressure in the air bleeding tank 40 increases due to the decrease of the cooling heat transfer surface 42*a*. Accordingly, by measuring the pressure Pt in the air bleeding tank 40 by the air bleeding tank pressure sensor 46 and by ascertaining the measurement value decreasing and thereafter, increasing so as to be the predetermined value or more such that that the differentia pressure between the pressure Pt and the condensation pressure Pc exceeds the set value, the increase of the liquid level of the liquid refrigerant in the air bleeding tank 40 is detected.

As described above, if the increase of the liquid level of the liquid refrigerant in the air bleeding tank 40 is detected, the step proceeds to Step S10, and the liquid refrigerant is drained.

[Liquid Level Detection by Calculation (Steps S8 and S9)]

As shown in Step S8, in a liquid level detection of the liquid refrigerant by a calculation, a condensed refrigerant amount is calculated. First, in order to calculate the condensed refrigerant amount (instantaneous value), the temperature in the air bleeding tank 40 is acquired. Specifically, an air bleeding tank temperature Tt is obtained by the air bleeding tank temperature sensor 48. In a case where the air bleeding tank temperature sensor 48 is not used, the air bleeding tank temperature may be calculated from the air bleeding tank pressure Pt obtained from the air bleeding tank pressure sensor 46. Specifically, a saturation temperature obtained from the air bleeding tank pressure Pt is referred to as the air bleeding tank temperature.

In addition, the condensed refrigerant amount (instantaneous value) is obtained from the cooling capacity of the cooler 42 and the condensed latent heat of the refrigerant.

The cooling capacity of the Peltier element using the cooler 42 is determined by a difference between a heat absorption-side temperature and a heat dissipation temperature, and a current flowing through the Peltier element. If the heat dissipation temperature (cooling water temperature or outside air temperature) and the current flowing through the Peltier element are constant, the cooling capacity Qp_W [W] which is the function of heat absorption-side temperature (≈ air bleeding tank internal temperature Tt) is calculated as the following Expression.

$$Qp_W=f(Tt) \tag{5}$$

The condensed latent heat Q_LH [kJ/kg] of the refrigerant is a difference between gas entropy and liquid entropy at a saturation temperature (saturation pressure), the condensed latent heat of the refrigerant is defined as a function of the air bleeding tank internal temperature Tt for each refrigerant as the following Expression.

$$Q_LH=f(Tt) \tag{6}$$

A condensed refrigerant amount (instantaneous value) G_in_ref [kg/h] is calculated as follows by the cooling capacity Qp_W and the condensed latent heat Q_LH obtained as described above.

$$G_in_ref=Qp_W/Q_LH\times 3600/10^3 \tag{7}$$

By integrating the condensed refrigerant amount (instantaneous value) obtained by the Expression (7) with time, the condensed refrigerant amount (integrated value) is obtained.

$$\text{Condensed Refrigerant Amount (Integrated Value)}=\Sigma\ \text{Condensed Refrigerant Amount (Instantaneous Value)} \tag{8}$$

In addition, if the condensed refrigerant amount (integrated value) exceeds the set value (Step S9), it is determined that the liquid level of the liquid refrigerant in the air bleeding tank 40 increases, the step proceeds to Step S10, and the liquid refrigerant is drained.

In Step S10, the drain solenoid valve 21 is opened, and the liquid refrigerant in the air bleeding tank 40 is discharged. The liquid refrigerant in the air bleeding tank 40 is introduced to the evaporator 14 through the drain pipe 19.

In Step S10, after a predetermined time elapses after the drain solenoid valve 21 is opened, the drain solenoid valve 21 is closed, and the drain of the liquid refrigerant is terminated (Step S11). The predetermined time is preset by experiment or the like before the chiller 1 is installed.

Next, whether or not the air which is the uncondensable gas accumulated in the air bleeding tank 40 is discharged to the outside (the atmosphere) via the exhaust pipe 50 is determined by detections of the following two methods.

[Detection by Pressure Change (Step S12)]

In Step 10, if the liquid refrigerant is discharged from the air bleeding tank 40, immersion of the cooling heat transfer surface 42*a* of the cooler 42 is eliminated, the cooling capacity is recovered, and thus, the pressure in the air bleeding tank 40 decreases. However, if the air of a predetermined amount or more which is the uncondensable gas stays in the air bleeding tank 40, the air covers the cooling heat transfer surface 42*a* and thus, the heat transfer performance decreases. Accordingly, in a case where the pressure in the air bleeding tank 40 does not decrease to the predetermined value or less after the liquid refrigerant is drained, it can be determined that the air in the air bleeding tank 40 of the predetermined amount or more stays in the air bleeding tank 40. In addition, in Step S12, in a case where a difference value obtained by subtracting the air bleeding tank pressure Pt obtained by the air bleeding tank pressure sensor 46 from the condensation pressure Pc obtained by the condenser pressure sensor 25 remains beyond a set value, that is, in a case where the air bleeding tank pressure Pt does not decrease to the predetermined value or less, it is determined that the air of a predetermined amount or more stays in the air bleeding tank 40.

In a case where it is determined that the air of the predetermined amount or more stays in the air bleeding tank 40, the step proceeds to Step S15, and the exhaust is prepared.

[Detection by Calculation (Steps S13 and S14)]

In Step S13, an air bleeding tank internal air amount (integrated value) which is the amount of the air which stays in the air bleeding tank 40 is obtained by a calculation. Specifically, the air bleeding tank internal air amount is calculated based on the air entering amount (integrated value) calculated in the above-described Step S2. In addition, in a case where the air bleeding tank internal air amount (integrated value) exceeds a set value (Step S14), it is determined that the air of the predetermined amount or more stays in the air bleeding tank 40, the step proceeds to Step S15, and the exhaust is prepared.

In Step S15, the exhaust of the gas in the air bleeding tank 40 is prepared. Specifically, the Peltier element of the cooler 42 is turned OFF, the air bleeding solenoid valve 18 is closed, and the heater 44 is turned ON. Accordingly, after the inside of the air bleeding tank 40 is sealed, the temperature inside the air bleeding increases, and thus, the pressure in the air bleeding tank 40 increases. In addition, the air bleeding tank pressure Pt obtained from the air bleeding tank pressure sensor 46 increases and exceeds a set value (atmospheric pressure+$\alpha$) which is higher than the atmospheric pressure by a predetermined value $\alpha$ (Step S16), the step proceeds to Step S17, and the exhaust starts.

In Step S17, the exhaust solenoid valve 52 is opened and the heater 44 is turned OFF. Accordingly, the gas which has the air in the air bleeding tank 40 as a main component is discharged to the outside (atmosphere) via the exhaust pipe 50. In this case, the heater 44 is turned OFF in order to not discharge the refrigerant remaining in air bleeding tank 40 to the outside more than necessary.

In addition, in a case where the pressure in the air bleeding tank 40 is less than a set value (atmospheric pressure+β) which is higher than the atmospheric pressure by a predetermined value β (Step S18), the step proceeds to Step S19. The reason why the set value is set to be higher than the atmospheric pressure by the predetermined value β is because if the exhaust solenoid valve 52 is opened until the pressure is lower than the atmospheric pressure, it is possible to prevent the atmosphere from flowing back into the air bleeding tank 40.

In Step S19, the exhaust solenoid valve 52 is closed, and the exhaust is terminated.

Next, the step proceeds to the steps after Step S20, and stopping of the air bleeding device 15 is determined.

In Step S20, an exhaust air amount (integrated value) which is the total amount of the air discharged to the outside (atmosphere) via the exhaust pipe 50 is calculated. Specifically, the calculation is performed as follows.

First, in order to obtain an air density ρ_t_air [kg/m$^3$] in the air bleeding tank 40, a refrigerant saturation pressure Pt_ref [MPa(abs)] in the air bleeding tank 40 is calculated. The refrigerant saturation pressure Pt_ref [MPa(abs)] in the air bleeding tank 40 is a saturation pressure equivalent to the temperature Tt in the air bleeding tank 40. Relational Expression between the saturation pressure and the saturation temperature can be defined as the following Expression which is a function of the saturation temperature for each refrigerant.

$$Pt_\mathrm{ref}=f(Tt) \tag{9}$$

Accordingly, an air partial pressure Pt_air [MPa(abs)] in the air bleeding tank 40 can be calculated as the following Expression using an air bleeding tank pressure Pt (total pressure).

$$Pt_\mathrm{air}=Pt-Pt_\mathrm{ref} \tag{10}$$

Accordingly, an air mass w_t_air [kg] in the air bleeding tank 40 is given as the following Expression from a state equation of an ideal gas.

$$w_t_\mathrm{air}=Pt_\mathrm{air}\times Vt\times M_\mathrm{air}/(R\times Tt) \tag{11}$$

Here, Vt is a volume [m$^3$] of the air bleeding tank 40, M_air is a molecular weight [kg/mol] of the air, R is a gas constant, and Tt is a temperature [K] in the air bleeding tank 40.

Accordingly, the air density ρ_t_air in the air bleeding tank 40 is as follows.

$$\rho_t_\mathrm{air}=w_t_\mathrm{air}/Vt \tag{12}$$

As described above, if the air density ρ_t_air in the air bleeding tank 40 is obtained, the exhaust gas amount w_ex_air [kg] is calculated.

The exhaust gas volume V_ex [m$^3$] is estimated from a differential pressure between the pressure Pt in the air bleeding tank 40 and the atmospheric pressure Pa and a time Time_ex [sec] at which the exhaust solenoid valve 52 is opened in Step S17.

$$V_ex=f(Pt-Pa,\mathrm{Time}_ex) \tag{13}$$

In addition, the exhaust gas volume V_ex may be obtained from the volume Vt of the air bleeding tank 40 and a pressure difference before and after the exhaust, instead of Expression (13).

The exhaust air amount w_ex_air is calculated as the following Expression using the exhaust gas volume V_ex and the air density ρ_t_air in the air bleeding tank 40 obtained as described above.

$$w_ex_\mathrm{air}=V_ex\times\rho_t_\mathrm{air} \tag{14}$$

The exhaust air amount w_ex_air obtained by Expression (14) is a value per one exhaust, and in a case where a plurality of times of exhausts are performed, a value obtained by multiplying the exhaust air amount w_ex_air by the number n of exhausts becomes the exhaust air amount (integrated value).

$$\text{Exhaust Air Amount (Integrated Value)}=w_ex_\mathrm{air}\times n \tag{15}$$

In this way, if the exhaust air amount (integrated value) is obtained, the step proceeds to Step S21.

In Step S21, whether or not the exhaust air amount (integrated value) exceeds the entering air amount (integrated value) obtained in Step S2 is determined.

In a case where the exhaust air amount (integrated value) exceeds the entering air amount (integrated value), it is determined that sufficient exhaust is performed, the step proceeds to Step S23, and the air bleeding device 15 is stopped.

Meanwhile, in a case where the exhaust air amount (integrated value) does not exceed the entering air amount (integrated value), the step returns to Step S4, and thus, the above-described air bleed, the drain, and the exhaust are repeated.

In addition, even in the case where the exhaust air amount (integrated value) does not exceed the entering air amount (integrated value), as shown in Step S22, when the increase of the air partial pressure Pt_air (refer to Expression (10)) in the air bleeding tank 40 within a predetermined time in advance is a set value or less, the step proceeds to Step S23, and the air bleeding device 15 is stopped. In Step S22, even in a case where the calculation of the exhaust air amount (integrated value) or the entering air amount (integrated value) is inaccurate for some reasons, if the increase in the air partial pressure in the air bleeding tank 40 is the set value or less, it can be determined that the air in the air bleeding tank 40 is approximately exhausted.

In Step S23 in which the air bleeding device 15 is stopped, the drain solenoid valve 21 is opened. Accordingly, the inside of the air bleeding tank 40 communicates with the evaporator 14. This is because the pressure in the air bleeding tank 40 is prevented from increasing due to influences of the outside air temperature.

As described above, according to the present embodiment, the following effects are exerted.

As described in Step S7, if the inside of the air bleeding tank 40 is cooled, the pressure in the air bleeding tank 40 decreases. However, if the condensation of the refrigerant in the air bleeding tank 40 proceeds, the liquid refrigerant is accumulated in the air bleeding tank 40, the liquid refrigerant covers the cooling heat transfer surface 42*a* installed in the height direction, and thus, the pressure in the air bleeding tank 40 increases due to the decrease of the cooling heat transfer surface 42*a*. Focusing on this phenomenon, by measuring the pressure Pt in the air bleeding tank 40 by the air bleeding tank pressure sensor 46 and by ascertaining the measurement value decreasing and thereafter, increasing so as to be the predetermined value or more such that that the differential pressure between the pressure Pt and the condensation pressure Pc exceeds the set value, the increase of the liquid level of the liquid refrigerant in the air bleeding tank 40 is detected.

In this way, it is possible to detect the liquid level of the liquid refrigerant in the air bleeding tank 40 without using a float type liquid level sensor, and thus, it is possible to provide the air bleeding device 15 having excellent maintainability.

Moreover, as described in Steps S8 and S9, the condensation amount of the chiller introduced into the air bleeding tank 40 is calculated from the cooling capacity of the Peltier element of the cooler 42 and the condensed latent heat of the refrigerant, and the increase of the liquid level of the liquid refrigerant in the air bleeding tank 40 is detected from the calculated condensation amount.

In this way, it is possible to detect the liquid level of the liquid refrigerant in the air bleeding tank 40 without using the float type liquid level sensor, and thus, it is possible to provide the air bleeding device 15 having excellent maintainability.

Moreover, as described in Step S12, if the liquid refrigerant is discharged from the air bleeding tank 40, the immersion of the cooling heat transfer surface 42*a* is eliminated and the cooling capacity is recovered, and thus, the pressure Pt in the air bleeding tank 40 decreases. However, if the uncondensable gas of the predetermined amount or more stays in the air bleeding tank 40, the uncondensable gas covers the cooling heat transfer surface 42*a*, and thus, heat transfer performance decreases. Taking this phenomenon, in the case where the liquid refrigerant is drained, and thereafter, the pressure in the air bleeding tank 40 does not decrease to a predetermined value or less, it can be determined that the uncondensable gas of the predetermined amount or more stays in the air bleeding tank 40. Accordingly, it is possible to simply determine that the uncondensable gas of the predetermined amount or more stays in the air bleeding tank 40, by the pressure Pt of the air bleeding tank, and it is possible to promptly discharge the uncondensable gas to the outside without waiting for the calculations such as Steps S13 and S14.

In addition, the configuration of the chiller 1 shown in FIG. 1 is an example, and the present invention is not limited to the configuration. For example, instead of a water-cooled condenser 12, an air heat exchanger may be configured to perform heat exchange between the outside air and the refrigerant. In addition, the chiller 1 is not limited to the case having only the cooling function, and for example, may have only a heat pump function or both the cooling function and the heat pump function.

In addition, when the increase of the liquid level of the liquid refrigerant in the air bleeding tank 40 is determined, the determination is performed to use both the liquid level detection by the pressure change (Step S7) and the liquid level detection (Steps S8 and S9) by calculation in combination. However, any one of both may be used.

In addition, although the Peltier element is used as the cooling device used for the cooler 42, the present invention is not limited thereto. Any cooling device may be used it can cool the inside of the air bleeding tank 40 to the condensation temperature or less of the refrigerant.

Moreover, although the electric heater is used as the heater 44, the present invention is not limited to this. Other types of heater such as a heater using a heat transfer tube through which a high-temperature refrigerant flows may be used as long as it can heat the inside of the air bleeding tank 40.

REFERENCE SIGNS LIST

1: chiller
11: compressor
12: condenser
13: expansion valve
14: evaporator
15: air bleeding device
16: control device (control unit)
17: air bleeding pipe
18: air bleeding solenoid valve (air bleeding valve)
19: drain pipe
20: inverter motor
21: drain solenoid valve (drain valve)
22*a*: cooling water forward pipe
22*b*: cooling water return pipe
23*a*: cooling water inlet temperature sensor
23*b*: cooling water outlet temperature sensor
24: cooling water flow rate sensor
25: condenser pressure sensor
32*a*: chilled water forward pipe
32*b*: chilled water return pipe
33*a*: chilled water inlet temperature sensor
33*b*: chilled water outlet temperature sensor
34: chilled water flow rate sensor
35: evaporator pressure sensor
40: air bleeding tank
42: cooler
44: heater
46: air bleeding tank pressure sensor
48: air bleeding tank temperature sensor
50: exhaust pipe
52: exhaust solenoid valve (exhaust valve)

The invention claimed is:

1. An air bleeding device, comprising:

an air bleeding pipe through which a mixed gas containing a refrigerant and an uncondensable gas is bled from a chiller;

an air bleeding tank in which the mixed gas bled through the air bleeding pipe is stored;

a cooler in which a cooling heat transfer surface which cools an inside of the air bleeding tank and condenses the refrigerant in the mixed gas is installed in a height direction in the air bleeding tank;

a drain pipe through which a liquid refrigerant in the air bleeding tank is discharged to the chiller;

an exhaust pipe through which the uncondensable gas in the mixed gas in the air bleeding tank is discharged to an outside;

an air bleeding tank pressure sensor which measures a pressure in the air bleeding tank; and a control unit which is configured to, when the cooler cools the inside of the air bleeding tank to condense the refrigerant, detect an increase of a liquid level of the liquid refrigerant in the air bleeding tank by a measurement value of the air bleeding tank pressure sensor decreasing by the cooling heat transfer surface in the liquid refrigerant being immersed and decreasing a heat transfer area cooling the gas and thereafter, increasing so as to be a predetermined value or more.

2. The air bleeding device according to claim 1, wherein in a case where the control unit detects the increase of the liquid level of the liquid refrigerant in the air bleeding tank, the liquid refrigerant is discharged from the air bleeding tank via the drain pipe.

3. The air bleeding device according to claim 2, wherein in a case where the liquid refrigerant is discharged from the air bleeding tank, and thereafter, a pressure in the air bleeding tank does not decrease to a predetermined value or less, the control unit determines that the uncondensable gas of a predetermined amount or more stays in the air bleeding tank.

4. The air bleeding device according to claim 3, wherein in a case where the control unit determines that the uncondensable gas of the predetermined amount or more stays in the air bleeding tank, the gas in the air bleeding tank is discharged from the exhaust pipe to the outside.

5. A chiller comprising:

the air bleeding device according to claim 1.

6. A chiller comprising:

the air bleeding device according to claim 2.

7. A chiller comprising:

the air bleeding device according to claim 3.

8. A chiller comprising:

the air bleeding device according to claim 4.

9. An air bleeding device, comprising:

an air bleeding pipe through which a mixed gas containing a refrigerant and an uncondensable gas is bled from a chiller;

an air bleeding tank in which the mixed gas bled through the air bleeding pipe is stored;

a cooler which cools an inside of the air bleeding tank and condenses the refrigerant in the mixed gas;

a drain pipe through which a liquid refrigerant in the air bleeding tank is discharged to the chiller;

an exhaust pipe through which the uncondensable gas in the mixed gas in the air bleeding tank is discharged to an outside; and a control unit which is configured to detect an increase of a liquid level of the liquid refrigerant in the air bleeding tank by an integrated value of a condensed refrigerant amount in the air bleeding tank calculated from cooling capacity of the cooler and condensed latent heat of the refrigerant being a predetermined value or more.

10. The air bleeding device according to claim 9, wherein in a case where the control unit detects the increase of the liquid level of the liquid refrigerant in the air bleeding tank, the liquid refrigerant is discharged from the air bleeding tank via the drain pipe.

11. A chiller comprising:

the air bleeding device according to claim 9.

12. A method of controlling an air bleeding device, the air bleeding device including an air bleeding pipe through which a mixed gas containing a refrigerant and an uncondensable gas is bled from a chiller, an air bleeding tank in which the mixed gas bled through the air bleeding pipe is stored, a cooler in which a cooling heat transfer surface which cools an inside of the air bleeding tank and condenses the refrigerant in the mixed gas is installed in a height direction in the air bleeding tank, a drain pipe through which a liquid refrigerant in the air bleeding tank is discharged to the chiller, an exhaust pipe through which the uncondensable gas in the mixed gas in the air bleeding tank is discharged to an outside, and an air bleeding tank pressure sensor which measures a pressure in the air bleeding tank, the method comprising:

detecting, when the cooler cools the inside of the air bleeding tank to condense the refrigerant, an increase of a liquid level of the liquid refrigerant in the air bleeding tank by a measurement value of the air bleeding tank pressure sensor decreasing by the cooling heat transfer surface in the liquid refrigerant being immersed and decreasing a heat transfer area cooling the gas and thereafter, increasing so as to be a predetermined value or more.

13. A method of controlling an air bleeding device, the air bleeding device including an air bleeding pipe through which a mixed gas containing a refrigerant and an uncondensable gas is bled from a chiller, an air bleeding tank in which the mixed gas bled through the air bleeding pipe is stored, a cooler which cools an inside of the air bleeding tank and condenses the refrigerant in the mixed gas, a drain pipe through which a liquid refrigerant in the air bleeding tank is discharged to the chiller, and an exhaust pipe through which the uncondensable gas in the mixed gas in the air bleeding tank is discharged to an outside, the method comprising:

detecting an increase of a liquid level of the liquid refrigerant in the air bleeding tank by an integrated value of a condensed refrigerant amount in the air bleeding tank calculated from cooling capacity of the cooler and condensed latent heat of the refrigerant being a predetermined value or more.

* * * * *